US010779691B2

(12) United States Patent
Rodriguez

(10) Patent No.: US 10,779,691 B2
(45) Date of Patent: Sep. 22, 2020

(54) SHOWER ACCESSORY

(71) Applicant: Gilbert Rodriguez, El Paso, TX (US)

(72) Inventor: Gilbert Rodriguez, El Paso, TX (US)

( * ) Notice: Subject to any disclaimer, the term of this patent is extended or adjusted under 35 U.S.C. 154(b) by 128 days.

(21) Appl. No.: 15/986,430

(22) Filed: May 22, 2018

(65) Prior Publication Data

US 2018/0333010 A1 Nov. 22, 2018

Related U.S. Application Data

(60) Provisional application No. 62/509,282, filed on May 22, 2017.

(51) Int. Cl.
*A47K 7/02* (2006.01)

(52) U.S. Cl.
CPC ..... *A47K 7/02* (2013.01)

(58) Field of Classification Search
CPC ..... A47K 7/02
See application file for complete search history.

(56) References Cited

U.S. PATENT DOCUMENTS 837,759 A * 12/1906 Weston ..... A47K 7/03 401/201
1,577,861 A * 3/1926 Beulah ..... A47K 7/03 401/201
1,909,966 A * 5/1933 Bartlett ..... A47K 7/03 401/201
2,099,484 A 11/1937 Hokerk
4,271,272 A * 6/1981 Strickman ..... A47K 7/03 521/109.1
4,457,643 A * 7/1984 Caniglia ..... A47K 7/03 401/200
D372,340 S 7/1996 Wendel
5,832,832 A * 11/1998 Carsel ..... B05C 17/00 101/379
6,478,756 B1 11/2002 Chen
7,083,351 B2 * 8/2006 Gueret ..... A45D 33/34 264/45.9
D553,316 S * 10/2007 Poizeau ..... D32/40
7,430,781 B2 * 10/2008 Collins ..... A47L 4/02 15/220.3
7,500,282 B1 * 3/2009 Park ..... A47K 7/02 15/160
7,621,802 B2 * 11/2009 McCarthy ..... B24D 15/04 451/523
9,226,625 B1 * 1/2016 Jefferson ..... A47K 7/02
9,723,957 B2 * 8/2017 Firestone ..... A47K 7/03
10,123,663 B2 * 11/2018 Avshalom ..... A47L 13/17
(Continued)

*Primary Examiner* — Marc Carlson
(74) *Attorney, Agent, or Firm* — Boudwin Intellectual Property; Daniel Boudwin

(57) ABSTRACT

A shower accessory for use in combination with soap and washcloth that produces a lather quickly. The shower accessory includes a member having a first end, a second end, an upper side, and a lower side. A portion of the member includes an irregular surface having a plurality of oblong protrusions that vary in size and disposed in a random pattern across the irregular surface of the member and designed to increase the total amount of lather produced by the soap. A concave portion is disposed on the lower surface of the member designed to allow the lather to quickly increase in volume. In this way, a user can quickly and efficiently clean themselves.

8 Claims, 2 Drawing Sheets

(56) References Cited

U.S. PATENT DOCUMENTS

| | | | | |
|---|---|---|---|---|
| 2003/0009118 | A1 | 1/2003 | Sabo et al. | |
| 2004/0186400 | A1 | 9/2004 | Thomas | |
| 2008/0221494 | A1 | 9/2008 | Squillace | |
| 2013/0276251 | A1* | 10/2013 | Guynn | A45D 29/17 15/104.94 |
| 2014/0013501 | A1* | 1/2014 | Murphy | B29C 45/14795 4/515 |
| 2016/0296082 | A1* | 10/2016 | Hicks | A47K 7/03 |

* cited by examiner

SHOWER ACCESSORY

CROSS REFERENCE TO RELATED APPLICATIONS

This application claims the benefit of U.S. Provisional Application No. 62/509,282 filed on May 22, 2017. The above identified patent application is herein incorporated by reference in its entirety to provide continuity of disclosure.

BACKGROUND OF THE INVENTION

The present invention relates to shower accessories. More specifically, the present invention provides a member having an irregular surface comprising a plurality of oblong protrusions vary in size and disposed in a random pattern across a portion of the member along with a concave portion disposed on a lower surface of the member.

While taking a shower or bath, many individuals use a washcloth or loofah in combination with a bar of soap or shower gel to clean themselves. However, it can be difficult to generate enough soap suds with a washcloth without continually reapplying the soap or shower gel, thereby frustrating the individual. Further, soap generates a soap scum on its surface that can dry out the skin. Additionally, loofahs generate an exorbitant number of bacteria if not replaced often, and many individuals either forget to do so or cannot afford to replace them that often. Thus, an improved shower accessory is desired to allow a person to more easily clean themselves in a fast and efficient manner.

SUMMARY OF THE INVENTION

In view of the foregoing disadvantages inherent in the known types of shower accessories now present in the known art, the present invention provides a shower accessory wherein the same can be utilized for providing convenience for the user when desiring to quickly and efficiently clean themselves in the shower.

It is therefore an object of the present invention to provide a new and improved shower accessory that has all of the advantages of the known art and none of the disadvantages. The present system comprises a member having a first end, a second end, an upper side, and a lower side, wherein a portion of the member comprises an irregular surface further comprising a plurality of oblong protrusions that vary in size and disposed in a random pattern across the irregular surface of the member. A concave portion is disposed on the lower surface of the member.

In one embodiment, the irregular surface covers the entire surface of the shower accessory, including the concave portion. In another embodiment, the member is cylindrically shaped, such that the first end and second end are both rounded. In a further embodiment, the concave portion is elongated such that it extends across the lower surface of the member. In one embodiment, the concave portion extends at least 25% the depth of the member. In another embodiment, the concave portion comprises a first concave portion and a second concave portion, each having a distinct depth, wherein the pair of concave portions are disposed such that they mirror one another. In a further embodiment, the pair of concave portions each have the same depth.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
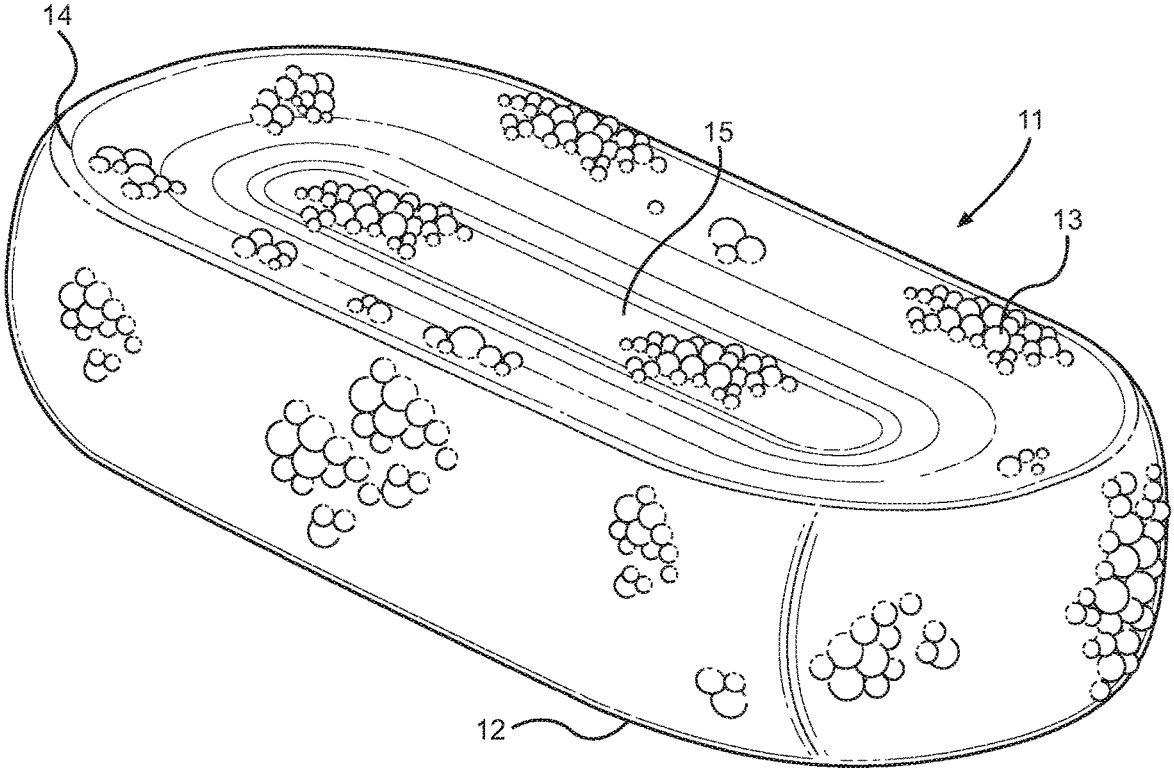
FIG. 1 shows a bottom perspective view of an embodiment of the shower accessory.

Reference is made herein to the attached drawings. Like reference numerals are used throughout the drawings to depict like or similar elements of the shower accessory. The figures are intended for representative purposes only and should not be considered to be limiting in any respect.

Figure 2:
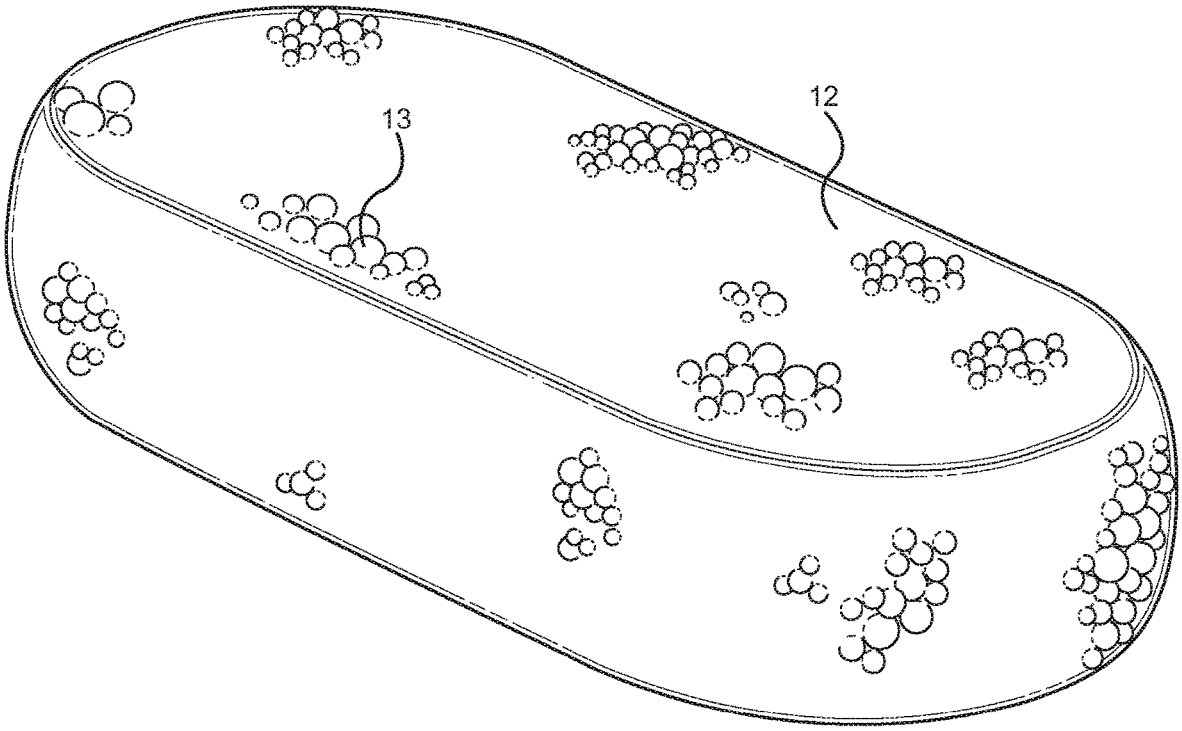
FIG. 2 shows a top perspective view of an embodiment of the shower accessory.

Referring now to FIG. 1 and FIG. 2, there is shown a bottom perspective view and a top perspective view of the shower accessory, respectively. A shower accessory 11 comprises a member having a first end, a second end, an upper side 12 and a lower side 14. In the illustrated embodiment, the member is cylindrically shaped such that the first end and the second end are rounded. In other embodiments the member is spherically shaped. The member is solid, and configured to be gripped, such that it is sized appropriately for a user's hand. In the illustrated embodiment, the member is composed of plastic, however in other embodiments it is composed of any hard, durable material. A portion of the member comprises an irregular surface 13.

In the illustrated embodiment, a portion the lower side 14 is tapered such that a concave portion 15 is produced thereby. The concave portion 15 is configured to quickly increase the volume of lather produced when the shower accessory 11 is in use by both increasing the total surface area of the member, and the cavity specifically forcing the soap molecules into increased contact with one another, thereby increasing the total amount of soap molecules and lather produced. In the shown embodiment, the lower side 14 begins tapering at a perimeter of the lower side 14. In one embodiment, the concave portion 15 is elongated, such that it extends completely across a longitudinal axis of the member, such that the concave portion 15 extends the full length of the member. In the shown embodiment, the longitudinal axis of the shower accessory 11 has a greater length than a lateral axis of the shower accessory 11.

In the illustrated embodiment, the concave portion 15 is V-shaped such that it comes to an inverted point. However, in other embodiments, the concave portion 15 tapers gradually such that the inverted point is less severely inclined, and the concave portion 15 forms a U-shaped indent in the lower surface 14. In one embodiment, the tapering begins from opposing sides of the lower side 14, such that the indent of the concave portion 15 extends to the same depth throughout the entire length of the concave portion 15, thereby forming a channel extending the length of the member. However, in other embodiments, the concave portion 15 is formed such that the taper extends equally from the full perimeter of the lower side 14. In this way, the indent of the concave portion 15 forms an apex at only the center of the lower side 14, thereby forming a well. However, in each embodiment, lather collects at the apex of the concave portion 15. In this way, a user can easily produce enough lather to wash their body, as the concave portion 15 pushes the soap suds into contact with one another and further promotes the foam production. In the illustrated embodiment, the concave portion 15 extends at least 25% the depth of the shower accessory 11 when measured from the apex of the concave portion 15. However, in other embodiments, the concave portion 15 extends less than 25% of the depth of the shower accessory 11 when measured from the apex of the concave portion 15.

Figure 3:
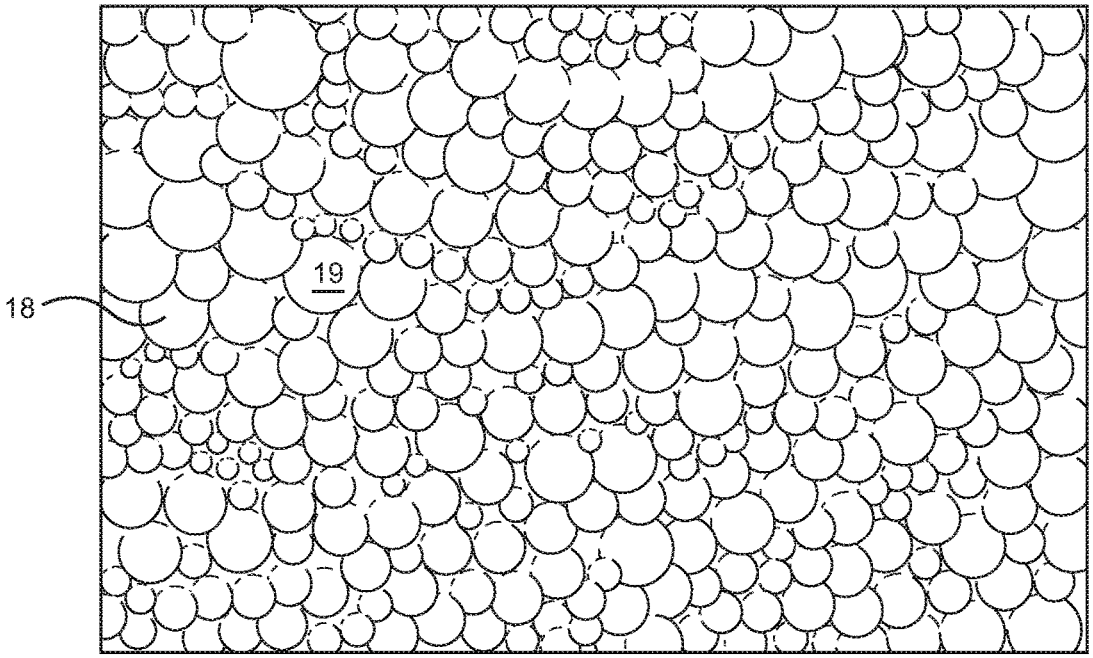
FIG. 3 shows close up view of an embodiment of the irregular surface.

Referring now to FIG. 3, there is shown a close up view of an embodiment of the shower accessory. The irregular surface 13 comprises a plurality of oblong protrusions 19 that vary in size, such that in one embodiment the smallest of the oblong protrusions 19 is at least 10% smaller than the size of the largest of the oblong protrusions 19. Additionally, the oblong protrusions 19 are disposed in a random pattern across the surface of the shower accessory 11. Although the oblong protrusions 19 are configured to be disposed randomly within the irregular surface 13, each oblong protrusion 19 contacts another oblong protrusion 19. In this way, each oblong protrusion 19 is disposed flush against another oblong protrusion 19, such that each sidewall 18 is in contact with another sidewall 18. Additionally, each oblong protrusion 19 is disposed such that an upper portion is exposed thereby allowing the plurality of oblong protrusions 19 to interact with the soap. In the shown embodiment, the oblong protrusions 19 vary in shape as well as size, such that spherical protrusions are also formed. However, in another embodiment, each oblong protrusion 19 is tapered at a portion of the sidewall 18 such that a teardrop shape is formed.

In the illustrated embodiment, the irregular surface 13 comprises the entire surface of the shower accessory 11, however in other embodiments the irregular surface 13 comprises only a portion of the shower accessory 11, such as only the upper side 12 of the member or only the lower side 14 of the member. The shower accessory 11 is configured to regularly come into contact with soap and other wash products, and the oblong protrusions 19 disposed randomly across the surface of the member promote the production of soap lather by increasing the total surface area. In this way, the irregular surface 13 is configured to increase the total amount of lather produced when soap and washcloth are applied to the shower accessory 11.

Figure 4:
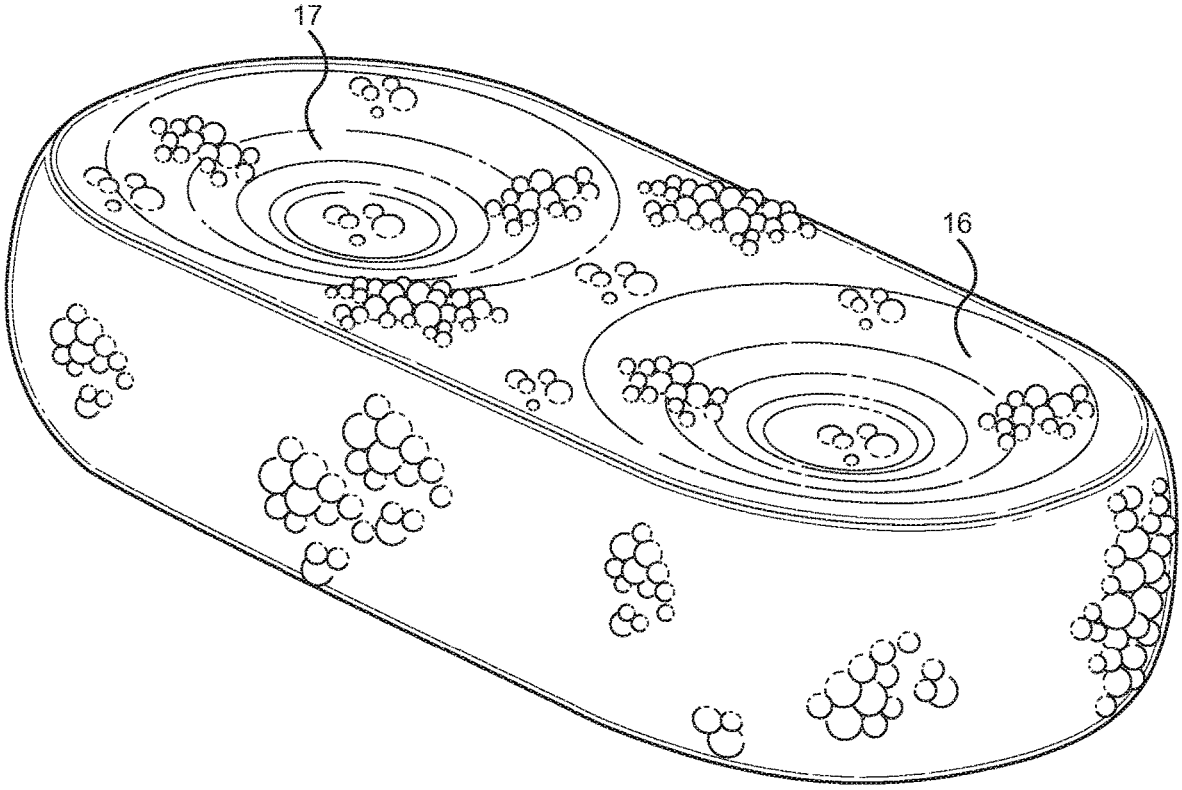
FIG. 4 shows another bottom perspective view of an embodiment of the shower accessory.

Referring now to FIG. 4, there is shown another bottom perspective view of an embodiment of the shower accessory. In one embodiment, the concave portion of the member comprises a first concave portion 16 and a second concave portion 17. In the illustrated embodiment, the pair of concave portions are disposed along the lower side of the member such that the first concave portion 16 mirrors the second concave portion 17 across a lateral axis of the member, wherein the lateral axis is perpendicular to the longitudinal axis as defined previously. In one embodiment, the first concave portion 16 and second concave portion 17 each comprise the same depth.

Alternatively, in the shown embodiment, the first concave portion 16 comprises a depth different from the depth of the second concave portion 17. In the illustrated embodiment, the first concave portion 16 tapers from the first end of the member and the second concave portion 17 tapers from the second end of the member, such that the pair of concave portions 16, 17 do not fully extend across the length of the lower side, and a middle portion of the lower side is not indented. However, in an alternate embodiment, the first concave portion 16 and second concave portion 17 each radiate from a point on the lower side such that the first concave portion 16 is cotangent with the second concave portion 17. In another embodiment, the first concave portion 16 overlaps the second concave portion 17.

Similar to the embodiment wherein the concave portion comprises only a single concave portion disposed throughout the lower side of the member, the first concave portion 16 and second concave portion 17 can taper such that each form a V-shape therein, or each form a U-shape therein, wherein the V-shape and U-shape indentations are as described above. In other embodiments, the concave portions 16, 17 can alternate such that one forms a specific indentation while the other forms the opposing indentation. In this way, the shape of the indentation within each concave portion 16, 17 varies depending on the preference of the user.

In operation, an individual will grasp the shower accessory in one hand and grasp a shower cleaning product, such as a bar of soap, in the opposing hand. The user can then take the bar of soap and apply it to the concave portion of the shower accessory, such that a lather or foam is formed within the concave portion. The irregular surface of the shower accessory propagates the foam within the concave portion and across the surface of the shower accessory, quickly producing a thick lather an individual can transfer to a washcloth, and thereby use to efficiently clean themselves.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shower accessory, comprising:

a body formed from a hard material configured to be gripped, such that the body is sized appropriately for a user's hand;

the body comprising a flat upper working surface and a concave lower working surface, wherein the concave lower working surface tapers into the body from an outer perimeter of the concave lower working surface;

the concave lower working surface is offset from the flat working surface by a thickness of the body forming side wall surfaces joining a upper outer perimeter of the flat upper working surface with the lower outer perimeter of the concave lower working surface, the concave lower working surface comprising a plurality of oblong protrusions disposed across the concave lower working surface forming an irregular surface on the concave lower working surface, the irregular concave lower working surface configured to increase a total amount of lather produced when placed in contact with a soap and a cleaning material.

2. The shower accessory of claim 1, wherein the flat upper working surface comprises a plurality of oblong protrusions disposed randomly across the flat upper working surface forming an irregular upper working surface, the irregular upper working surface configured to increase a total amount of lather produced when placed in contact with the soap and the cleaning material.

3. The shower accessory of claim 2, wherein the side wall surfaces comprise a plurality of oblong protrusions disposed randomly across the side wall surfaces forming irregular side wall surfaces, the irregular side wall surfaces configured to increase a total amount of lather produced when placed in contact with the soap and the cleaning material.

4. The shower accessory of claim 1, wherein the concave lower working surface comprises a single concave portion that extends substantially the full length of the body.

5. The shower accessory of claim 1, wherein the concave lower working surface comprises a plurality of concave portions.

6. The shower accessory of claim 1, wherein a perimeter of each oblong protrusion contacts a perimeter of an adjacent protrusion.

7. The shower accessory of claim 1, wherein the concave lower working surface extends at least 25% the thickness of the body.

8. The shower accessory of claim 1, wherein the material is plastic.

* * * * *